United States Patent [19]

Sweeney

[11] 4,366,866

[45] Jan. 4, 1983

[54] SPLIT ESCUTCHEON SYSTEM

[76] Inventor: Thomas M. Sweeney, 7333 Holliday Dr., West, Indianapolis, Ind. 46260

[21] Appl. No.: 243,706

[22] Filed: Mar. 16, 1981

Related U.S. Application Data

[63] Continuation of Ser. No. 20,993, Mar. 16, 1979, abandoned.

[51] Int. Cl.[3] ..... A62C 37/08

[52] U.S. Cl. ..... 169/37; 285/46; 174/66

[58] Field of Search ..... 169/37, 38, 41; 239/209, 288, 288.3, 288.5; 126/315, 317; 220/241, 306; 285/46; 174/66, 68 R

[56] References Cited

U.S. PATENT DOCUMENTS 3,964,549 6/1976 McGill ..... 169/37

*Primary Examiner*—Stanley H. Tollberg

*Assistant Examiner*—Kenneth Noland

*Attorney, Agent, or Firm*—Jenkins, Coffey, Hyland, Badger & Conard

[57] ABSTRACT

An escutcheon system to provide a decorative surface about the sprinkler head of a fire protection system may be provided by two identical molded plastic parts and a molded plastic shim. Each of the parts can provide half of the decorative surface with end portions capable of being assembled together or capable of interlocking engagement, and with a central recess to fit about the sprinkler head. The decorative shim is capable of assembly in the system and of extending the decorative edge of the escutcheon to provide for variations in the position of the sprinkler head and the adjoining building surface. Such parts may be assembled about a sprinkler head and are capable of being removed from about the sprinkler head by manipulation of the two parts without breaking the integrity of the fire protection system.

11 Claims, 6 Drawing Figures

SPLIT ESCUTCHEON SYSTEM

This is a continuation of application Ser. No. 020,993 filed Mar. 16, 1979 now abandoned.

This invention relates to an escutcheon system to form a decorative surface about a pipe system, and more particularly relates to a decorative split escutcheon and to a decorative shim adapted for a sprinkler head drop of a fire protection system.

Where the sprinkler heads of a fire protection system extend through the ceiling or wall of the building, the opening through which the sprinkler head or pipe extends frequently provides a disagreeable appearance because its edge does not match the periphery of the pipe or because it has become damaged in assembly of the pipe system. It is desirable to provide a decorative surface to cover the opening through which the sprinkler head or pipe extends in order to avoid an unpleasant and disagreeable appearance and to maintain the architectural appearance of the building interior by hiding the interface between the pipe system and the building surfaces.

In the past, the escutcheons provided for such purposes have included integral stamped metal or spun metal parts in a variety of sizes adapted to be fitted about the threaded portion of the sprinkler head as the system is assembled, but after the ceiling pad is in place. Such escutcheons, when used to decorate fire protection sprinkler heads installed through a drop ceiling, create difficulty in subsequent efforts to maintain the building. Drop ceilings, which are in common use in industrial environments, include a plurality of panels dropped into a metallic lattice network which hangs from the structure of the building. The plumbing of the fire protection system of the building is generally above and hidden from view by the drop ceiling. However, it is necessary, for protection of the building interior, that the sprinkler heads from the fire protection system be positioned below the drop ceiling. Thus, each sprinkler head is located at the end of a pipe dropping from the plumbing of the fire protection system and extending through the panels of the drop ceiling. Upon installation the panels of the drop ceiling can be provided with a hole through which the pipe extends. The panels can then be fitted in place over the pipes, the decorative metal escutcheon can be slipped onto the threaded portion of the sprinkler heads which are then tightened into place at the end of each pipe drop.

When ceiling panels become discolored, for example, by water leaking through the roof or from normal aging, their replacement represents a maintenance job which is inordinately difficult, time-consuming and expensive. The damaged panel may, of course, be cut away from the integral escutcheon and sprinkler head of the fire protection system since it is to be discarded; however, because of the integral escutcheon, the new panel may not be easily replaced without damaging the panel. Cutting the new panel to fit it behind the existing escutcheon is undesirable, of course, to the appearance of the building. Thus, the fire protection system must be turned off so that the sprinkler head and escutcheon may be removed and the panel installed by providing it with a hole and slipping it over the pipe system as in the original installation.

Not only must the fire protection system be shut down for such ceiling repairs, but it must be drained to avoid the quantity of water within the system from flowing into the building when the sprinkler head is removed. Even when the fire protection system is drained, water remains in the pipe drop between the plumbing of the system and the sprinkler head, and some means must be provided to catch the water flowing from this length of pipe to avoid water damage within the building.

Further problems exist in the original installation of fire protection systems with sprinkler head drops and drop ceilings. The metallic lattice of the drop ceiling hangs from a plurality of wire supports from overhead, and the sprinkler heads depend from a plurality of pipes which must be cut to length and fitted by means of threaded couplings to provide water-tight joints. Because of the difficulty of cutting and fitting the lengths of pipe from which the sprinkler heads depend while maintaining water-tight threaded couplings and a consistent length, it is extremely difficult to maintain a uniform distance between the base of the sprinkler head when fitted to the pipe system and the surface of the ceiling panels. Thus, in the installation of such fire protection systems, it frequently becomes necessary to disassemble, recut and rethread the length of pipe extending between the fire protection system to the sprinkler head to obtain a consistent spacing between the surface of the ceiling panels and the sprinkler heads which extend through them.

Removable escutcheons for pipe systems are available that include two semi-annular metal stampings permanently hinged together at one end so that they may be opened and closed in scissor-like fashion. These escutcheons have fasteners attached to the unhinged other ends permitting them to be locked together as they are closed, but such escutcheons do not provide a pleasing appearance because of the presence of the hinge on the one side and the apparent parting line on the other side. Furthermore, prior two-piece escutcheons have been used with recessed sprinkler heads to permit removal of the escutcheon without breaking the integrity of the fire protection system. Such prior two-piece escutcheons have, however, included an annular decorative skirt that is threaded onto a threaded annular cast or formed connector that fits around the threaded portion of the sprinkler head. Such prior two-piece systems are expensive.

In accordance with this invention, a system to form a decorative surface about a pipe can include a first means forming a decorative surface with an inner opening having a perimeter permitting it to encompass the pipe and two end portions that are capable of assembly to permit the first means to be interlocked about and decorate a pipe system. A second means can form a further decorative surface and can provide for variations in spacing between the first means and an adjoining building surface. The first means to form a decorative surface about the pipe can include two separate molded parts. Each part can include a recess having a perimeter permitting it to encompass the pipe. The end portions of the parts can have portions capable of interlocking.

Preferably, a decorative surface can be provided about the pipe by two parts, each part having a decorative surface with a recess to fit about the pipe and with one end portion having a surface capable of assembly to the surface of the other end portion to permit two such parts to be interlocked about and decorate a pipe system. Such parts, when assembled, may provide a decorative escutcheon for the sprinkler heads of a fire protection system. The parts may be molded from a thermoplastic material and include a decorative extended surface with a skirt portion. Each such part may have a recess with a semi-circular perimeter and two parallel end portions which extend from each end of the semi-circular perimeter of the recess. The two parallel end portions may preferably lie in a single plane. Such parts can be assembled in pairs to form a decorative surface about a sprinkler head.

Thus, two identical semi-annular escutcheon parts can be provided with surfaces designed to be interlocked to permit the identical parts to be easily assembled into an integral annular decorative escutcheon about a sprinkler head. The parts may also be easily removed from the sprinkler head by manipulation of the two parts without breaking the integrity of the fire protection system. Each of the two identical semi-annular escutcheon parts will include a decorative, generally semi-annular surface and two end portions, one of which may be provided with a projection and the other may be provided with an opening that is engageable by the projection so that these parts may be snapped together and retained as an assembly in position about the sprinkler head.

The decorative shim of the system which comprises a second means is formed with an extended decorative portion having an inner opening permitting it to be fitted over the pipe system. An inner surface is formed within the inner opening to be engaged by the first means described above. This inner surface is so located with respect to the end portions of the extended decorative portion that it provides a different spacing between the inner surface and each end of the extended decorative portion of the shim. Preferably such a decorative annular shim includes a cylindrical portion with an annular web extending from within the cylindrical portion that is generally a plane perpendicular to the axis of rotation of the cylindrical portion and is located at unequal distances from the ends of the cylindrical portions. The annular web forms an inner opening having a perimeter to permit it to be fitted over a fire protection sprinkler head and the decorative escutcheon, when assembled, fits within the cylindrical portion and engages the annular web. Thus, the decorative surfaces of the escutcheon and the shim are contiguous; and the shim, depending upon which end of the decorative surface is adjacent the escutcheon, can provide variation in the distance between the decorative escutcheon and an adjoining building surface. The system of this invention is, thus, particularly useful in the installation and maintenance of fire protection systems having sprinkler heads which extend through the drop ceilings of a building.

Further features and advantages of the invention will be apparent from the following description of drawings in which.

Figure 1:
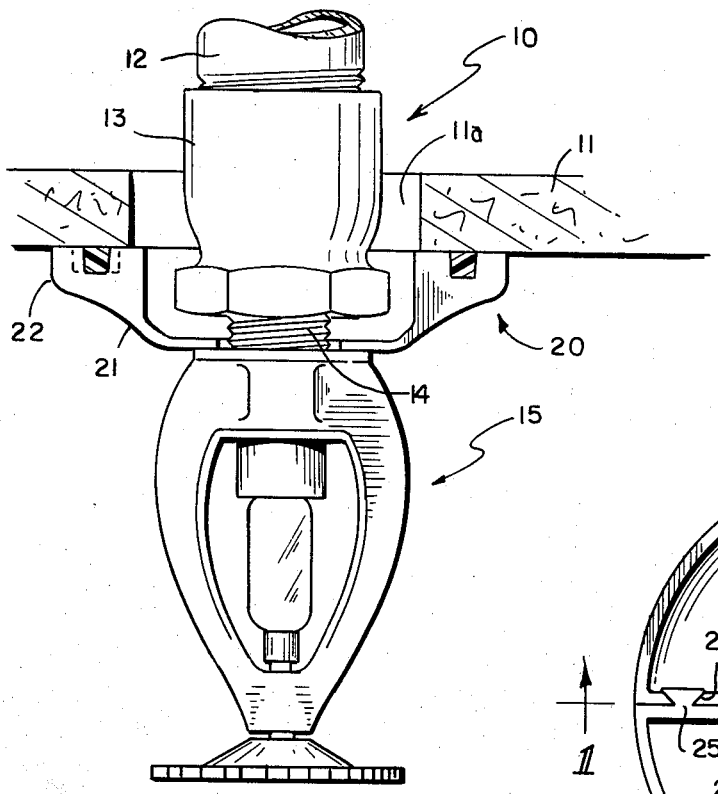
FIG. 1 is a partial cross-sectional drawing of a sprinkler head in a drop-ceiling environment with an escutcheon of my invention in place.

Referring now to FIG. 1, the drop of a sprinkler head system 10 is shown extending through a panel 11 of a drop ceiling. The sprinkler head drop includes a pipe 12 which may extend several feet from the plumbing of the fire protection system above the panel 11 of the roof. A fitting 13 is placed on the end of the pipe 12 and provides a threaded coupling for engagement by the threads 14 of the sprinkler head 15. A split escutcheon 20 of my invention is shown assembled about the pipe system 10 between the sprinkler head 15 and the panel 11 of the drop ceiling. The split escutcheon 20 provides a decorative surface 21 extending between the sprinkler head 15 and the panel of the drop ceiling 11. The decorative surface 21 may be provided with a skirted portion 22, if necessary, to hide the opening 11*a* between the ceiling panel and the pipe system 10. The extended decorative surface 21, including any skirt portion, may be provided in any shape or with any surface decoration consistent with a pleasing appearance. The escutcheon 20 of this invention may be easily assembled as shown, and preferably by snapping two identical split escutcheon parts together as will be described.

Figure 2:
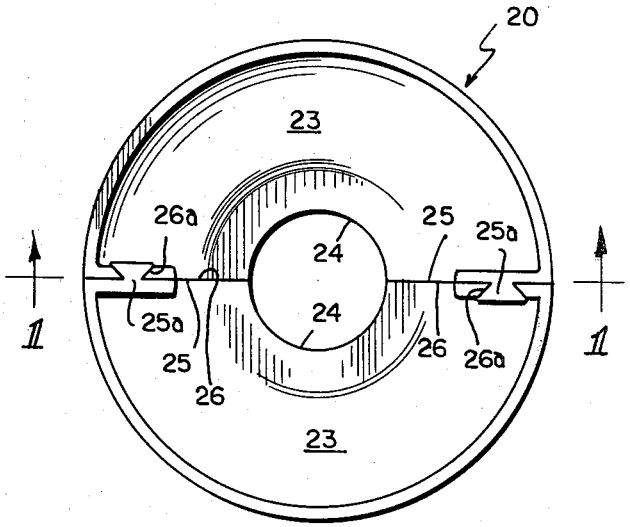
FIG. 2 is a view of the back of an escutcheon of my invention.

FIG. 2 shows a split escutcheon of this invention from its rear. The split escutcheon 20 is comprised of two identical parts 23. Each of the identical parts is preferably generally semi-annular in shape with its extended decorative surface having a recess with a semi-circular perimeter 24 and two ends 25 and 26, preferably lying in a single plane. One of the ends 25 is provided with a projection 25*a*, and the other of the ends 26 is provided with an opening formed by surfaces 26*a* and engageable by the projection 25*a*, as shown by FIG. 2. In the specific embodiment shown, the projection 25*a* is larger at its end than at its base, and the surfaces 26*a* forming the opening of the other end of the split escutcheon have a configuration matching the cross section of the projection 25*a*.

Figure 3:
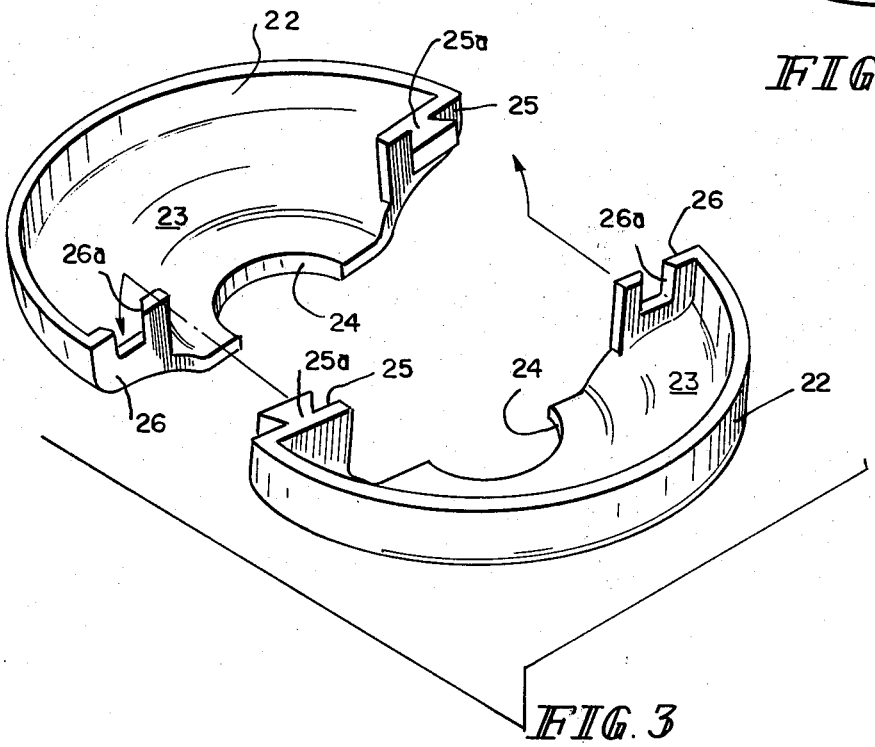
FIG. 3 is a perspective view illustrating an escutcheon of my invention and indicating its manner of assembly.

As shown in FIG. 3, two such parts can be snapped together by slightly rotating each of the parts about an axis generally perpendicular to the plane in which the ends lie, pressing the ends together and counter-rotating the ends about the axis generally perpendicular to the plane to interfit and engage the projection 25*a* in the opening formed by the surfaces 26*b*. Such a split escutcheon, when snapped together, is retained as an assembly and can be molded to provide an almost invisible parting line where the ends of the parts 23 meet. In addition, such an escutcheon may be assembled into an integral, annular, decorative unit about a sprinkler head as shown in FIG. 1 and can be removed from the sprinkler head by manipulation of the two parts without breaking the integrity of the fire protection system; for example, once assembled, the split escutcheon can be disassembled by merely rotating the two parts about an axis perpendicular to the plane in which the ends 25 and 26 of each part lie.

Figure 4:
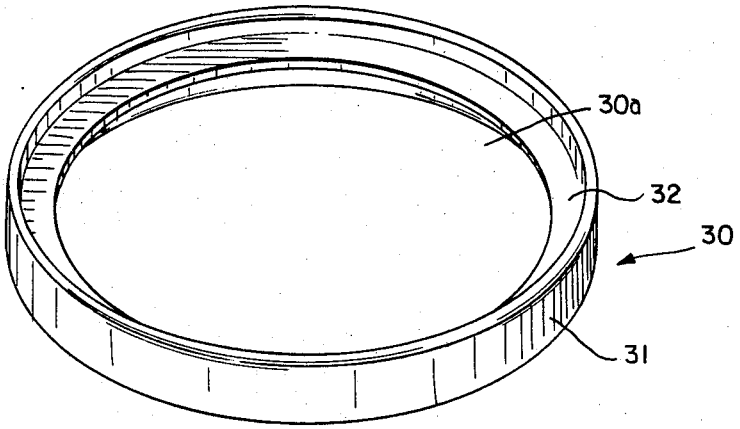
FIG. 4 is a perspective view of a decorative shim of my invention.
Figure 5:
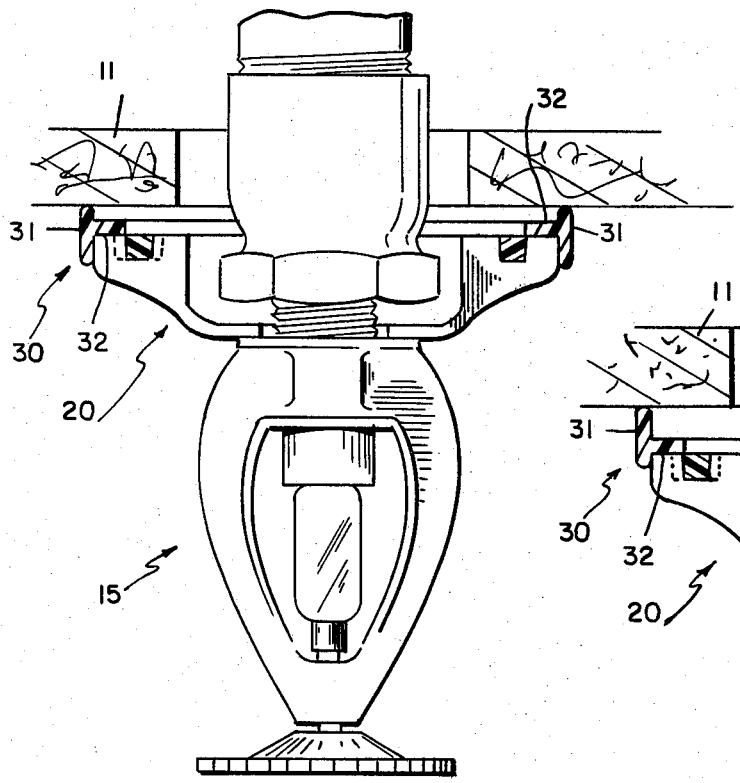
FIG. 5 is a partial cross-sectional drawing of a sprinkler head in a drop-ceiling environment with the system of my invention in place.
Figure 6:
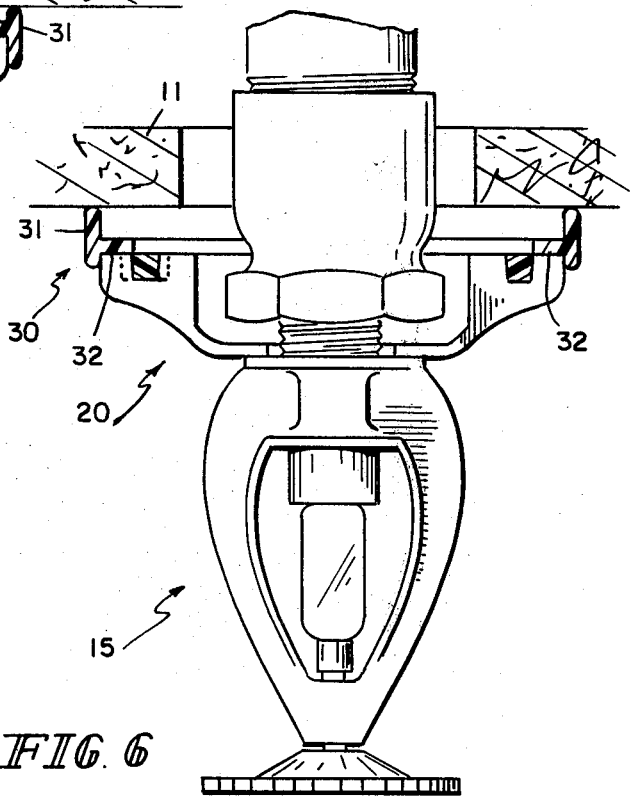
FIG. 6 is another partial cross-sectional drawing of the system of my invention providing for greater spacing between a sprinkler head and drop-ceiling panel.

The system of this invention further is capable of providing for installations in which the spacing between the sprinkler head 15 and the ceiling panel 11 is such that the decorative escutcheon 20 does not fit against the ceiling panel 11. A decorative shim 30, as shown in FIG. 4, may be used to provide a further decorative surface extending between the decorative escutcheon 20 and the ceiling panel 11 in the manner shown in FIG. 5 and FIG. 6. The decorative annular shim 30 includes an extended decorative portion 31, preferably in cylindrical form. The shim includes an inner opening 30*a*, as shown in FIG. 4, large enough to permit the decorative shim 30 to be fitted over a sprinkler head 15. An inner surface 32 is formed within the inner opening 30*a*. This inner surface is to be engaged by the decorative escutcheon 20, as shown in a cross-sectional view in FIG. 5 and FIG. 6. This inner surface is preferably an annular web extending from within the cylindrical decorative portion 31 generally in a plane that is perpendicular to the axis of rotation of the decorative portion and located along the axis of rotation of the decorative portion at a position unequally spaced from the ends of the cylindrical decorative portion. In the system shown, the decorative escutcheon 20 fits within the decorative cylindrical portion 31 of the decorative shim and engages the annular web 32. Because of the unequal spacing of the annular web 32 between the ends of the decorative cylindrical surface 31, the decorative shim 30 may be installed to decorate the pipe system where the distance between the decorative shim 20 and the ceiling panel 11 are closely spaced, as in FIG. 5 or where the distance between the decorative shim 20 and the ceiling panel 11 are more widely spaced, as shown in FIG. 6. In the system of this invention, the decorative escutcheon 20 and shim 30 can, thus, provide for a plurality of spacings between the sprinkler heads 15 of the fire protection ceiling and the ceiling panels 11. In its preferable embodiment, this system comprises only two parts which can provide the advantages of the system set forth above.

Although a split escutcheon system in which the ends of the split escutcheon lie in a single plane has been shown and described, the split escutcheon may be made having ends which do not lie in a single plane. The ends, however, should be generally parallel upon assembly and the minimum opening forming access to the recess within the escutcheon should have sufficient size to permit the parts to be assembled over the pipe system. Furthermore, although the split escutcheon is shown with generally semi-annular decorative surfaces, the extended decorative surface can have any configuration, such as a square, rectangular or polygon shape as desired.

Other departures from the specific embodiment shown may be devised without parting from the spirit and scope of the invention as set forth in the following claims.

I claim:

1. A decorative escutcheon for a sprinkler head drop of a fire protection system which escutcheon fits between the sprinkler head and the sprinkler pipe, said escutcheon comprising two identical semi-annular escutcheon parts, each escutcheon part including a decorative generally semi-annular surface and two end portions, each end portion of each escutcheon part having surfaces lying in the plane that generally bisects the assembled escutcheon and is normal to its annular decorative surface, one end surface of each escutcheon part having a portion projecting from the plane of its surface and the other end surface having an opening, said projecting portion of said one surface and said opening of said other surface being designed to be interlockable to permit the identical parts to be assembled into an integral annular decorative escutcheon about a sprinkler head and to be removed from the sprinkler head without the use of tools by twist-locking manipulation of the two parts by relative rotation of each escutcheon part about an axis perpendicular to said plane without breaking the integrity of the fire protection system.

2. The decorative escutcheon of claim 1 wherein the two portions lie in the same plane and the projecting portion of the one end portion has a key-like shape that is larger at its distal end than at its base and the opening in the other end portion is a slot formed by walls that mate the key-like shape of the projecting portion.

3. A method of decorating a pipe system existing through the surfaces of a building comprising providing two identical interfitting decorative escutcheon parts, each of the two decorative escutcheon parts having end portions lying in a single plane with a projection on one end portion of each of said escutcheon parts and a projection-receiving opening in the other end portion of each of said escutcheon parts, fitting the two escutcheon parts over the pipe system between the sprinkler head and the sprinkler pipe where it breaks the surfaces of the building and fastening the two escutcheon parts into a decorative assembly hiding the interface between the pipe system and the building surfaces by placing the two identical escutcheon parts over a pipe of the system with their ends adjacent to each other and slightly rotating the parts about an axis perpendicular to said plane, interfitting the projection and projection-receiving portions of the parts in overlapping relationship, and snapping the parts into interlocked engagement by counter-rotation to provide an assembled decorative escutcheon without the use of tools.

4. The method of claim 3 wherein the interfitting portions of the escutcheon parts include a projection on one end and a slot-like opening on the other end, and the parts are interfitted by rotating one end portion with respect to the other end portion about an axis perpendicular to the plane of the end portions, and engaging the key-like projection in the slot-like opening by counter rotating the parts to interfit the end portions.

5. The method of claim 3 in the repair of a damaged panel of a drop ceiling with a fire protection sprinkler head extending through the panel comprising disassembling the two escutcheon parts by disassembling their interlocking ends, removing the damaged panel of the drop ceiling, cutting a hole in the new ceiling panel large enough to clear the sprinkler head and pipe system and fitting the new panel in place, and fitting the two escutcheon parts between the sprinkler head and the new panel by assembling the two escutcheon parts into a decorative assembly hiding the hole in the new panel.

6. A system capable of manufacture by plastic molding to provide an extended decorative surface with a plurality of lengths and capable of installation without the use of tools, comprising an escutcheon part having a decorative extended surface and skirt portions, including a recess with a semi-circular perimeter in the decorative extended surface and having two end surfaces lying in planes capable of an overlapping and mating relationship, one of said end surfaces including a key-like projection and the other of said end surfaces including an opening with surfaces mating with the key-like projection, said part being capable of assembly in pairs by the manipulation of snapping the overlapping and mating surfaces together to interlock them into an integral decorative pipe escutcheon, and a decorative annular shim having an extended decorative outer surface with two ends and having an inner opening permitting it to be fitted over the pipe system and to encompass a portion of the integral decorative pipe escutcheon, said inner opening forming off-center inner surfaces to be engaged by the integral decorative pipe escutcheon, said off-center inner surfaces being so located with respect to the end portions of the extended decorative outer surface of the shim that, upon reversal end for end, it provides a different spacing between each end of the extended decorative outer surface of the shim and the inner surface to be engaged by the integral decorative pipe escutcheon.

7. A system to form a decorative surface about a pipe comprising escutcheon means to form a decorative surface comprising two separate identical molded parts, each part having end portions and an inner recess permitting said escutcheon means to encompass the pipe between the sprinkler head and the sprinkler pipe, said end portions of said parts having mating projecting portions and corresponding receiving portions being capable of interlocking when the escutcheon parts are rotated in one direction to permit the projecting and receiving portions to overlap and then interlock when the escutcheon parts are counter rotated and snap fitted together, and shim means to form a further decorative surface having an inner opening permitting it to be fitted over the pipe system and having an extended decorative portion with two end surfaces, said inner opening being formed in part by an inner surface radially extending about the inner opening to be engaged by said escutcheon means, said two end surfaces extending perpendicularly and on opposite sides of the inner surface, said inner surface being so located with respect to the end surfaces of the extended decorative portion of the shim means that it provides a different spacing between the inner surface of the shim means and each end surface of the extended decorative portions, said decorative surfaces of the escutcheon and shim means being contiguous when assembled.

8. A method of decorating a fire protection system with sprinkler heads extending through the surfaces of a building ceiling comprising providing two decorative escutcheon parts capable of interfitting engagement by twist-locking mating portions together without the use of tools, providing a decorative annular shim having an extended decorative outer surface with two ends and having an inner opening permitting it to be fitted over a sprinkler head, said inner opening forming off-center inner surfaces to be engaged by the decorative pipe escutcheon, said off center inner surfaces being so located with respect to the end portions of the extended decorative outer surface of the shim that, upon reversal end for end, it provides a different spacing between each end of the extended decorative outer surface of the shim and the inner surface to be engaged by the decorative pipe escutcheon, said decorative shim being adapted to be engaged by the two interfitting decorative escutcheon parts and to provide, with said decorative escutcheon parts, a further decorative surface having a plurality of lengths depending upon its engagement with the escutcheon parts, orienting the decorative shim to provide the desired engagement with the escutcheon parts and length of decorative surface and fitting it over the sprinkler head, fitting the two escutcheon parts over the sprinkler head and twist-locking the two escutcheon parts into a decorative assembly and placing the interfitted escutcheon parts in engagement with the decorative shim to hide thereby the interface between the sprinkler head and the building ceiling.

9. The method of claim 8 wherein the two decorative escutcheon parts are identical and have interfitting end portions lying in a single plane and the two parts are fitted to the system by placing the two identical escutcheon parts over a pipe of the system with their ends adjacent to each other and interfitting the end portions of the parts to provide an assembled decorative escutcheon, and fitting the assembled decorative escutcheon into a recess formed in the decorative shim.

10. A decorative escutcheon for a pipe system, said escutcheon comprising two identical escutcheon parts, each escutcheon part including a decorative generally semi-annular surface and two end portions, each end portion of each escutcheon part having major surfaces lying in planes that are generally normal to its semi-annular decorative surface, one end surface of each escutcheon part having a portion projecting from the plane of its surface and the other end surface having an opening, said projecting portion of said one surface and said opening of said other surface being designed to be interlockable to permit the identical parts to be assembled into an integral, generally annular decorative escutcheon about a pipe and to be removed therefrom without the use of tools by manipulation of the two parts by relative rotation of each escutcheon part about an axis generally perpendicular to said planes and without breaking the integrity of the pipe system.

11. A decorative escutcheon for a pipe system, said escutcheon comprising two identical escutcheon parts, each escutcheon part including a decorative generally semi-annular surface and two end portions, the two end portions of each escutcheon part having surfaces lying in planes that form a closely mating interface when the two escutcheon parts are assembled and that are generally normal to its semi-annular decorative surface, one end surface of each escutcheon part having an interlockable portion projecting from the plane of its surface and the other end surface having an opening to receive the interlockable portion, said projecting portion of said one surface and said opening of said other surface being designed to be engageable by twist-locking manipulation and relative movement of the two parts along the planes of the interface to permit the identical parts to be assembled into an integral, generally annular decorative escutcheon about a pipe and to be removed therefrom without the use of tools and without breaking the integrity of the pipe system.

* * * * *

UNITED STATES PATENT AND TRADEMARK OFFICE

CERTIFICATE OF CORRECTION

PATENT NO. : 4,366,866

DATED : January 4, 1983

INVENTOR(S) : Thomas M. Sweeney

It is certified that error appears in the above-identified patent and that said Letters Patent is hereby corrected as shown below:

Column 4, line 35, delete "by" (second occurrence) and insert --in-- therefor.

Column 6, line 34, after the word "a" insert --key-like--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*